United States Patent [19]

Hara

[11] 4,412,474

[45] Nov. 1, 1983

[54] FIBER CORDAGE

[75] Inventor: Hiromasa Hara, Toyokawa, Japan

[73] Assignee: Tokyo Rope Manufacturing Co., Ltd., Japan

[21] Appl. No.: 295,068

[22] Filed: Aug. 21, 1981

[30] Foreign Application Priority Data

Aug. 29, 1980 [JP] Japan ..... 55-122931[U]

[51] Int. Cl.[3] ..... D04C 1/12

[52] U.S. Cl. ..... 87/6; 57/230

[58] Field of Search ..... 87/5–9; 57/210, 230, 231

[56] References Cited

U.S. PATENT DOCUMENTS

| | | | |
|---|---|---|---|
| 2,737,075 | 3/1956 | Poirier et al. | 87/6 |
| 3,030,851 | 4/1962 | Meyer | 87/6 |
| 3,078,755 | 2/1963 | Chace, Jr. | 87/6 X |
| 3,141,372 | 7/1964 | Benk | 87/6 |
| 3,968,725 | 7/1976 | Holzhauer | 87/6 |
| 4,022,010 | 5/1977 | Gladenbeck et al. | 57/231 |

*Primary Examiner*—John Petrakes

[57] ABSTRACT

A fiber cord comprises a core which is formed by braiding a plurality of strands, each comprising at least one fiber filament of high elongation. Around the core, an outer layer element is formed by braiding a plurality of strands, each comprising at least one fiber filament of low elongation and high strength. Around the outer layer element, a protective layer element is formed by braiding a plurality of strands, each comprising at least one fiber of high elongation.

8 Claims, 4 Drawing Figures

FIBER CORDAGE

BACKGROUND OF THE INVENTION

1. Field of the Invention

The present invention relates to a fiber cord or rope which is suitable for use as a mooring rope for ships, and particularly to a fiber cord of triple-braided structure.

2. Description of the Prior Art

A cord of double-braided structure is known which has been conventionally utilized as a mooring rope for ships. This structure is constituted by a core which is formed by knitting and braiding a plurality of strands, each comprising one or more of fiber filaments or yarns, and by an outer layer which is formed by knitting and braiding a plurality of strands to surround the core. Each filament which forms such a rope has been only a nylon fiber or a Tetoron fiber which is a well known polyethylene terephthalate fiber available from Toray Corp., Japan. However, since this fiber has high elongation and low tensile strength, cords which are formed by such a fiber do not show high tensile strength.

Recently, a polyaramid fiber which has remarkable low elongation and high tensile strength as compared with nylon or Tetoron fibers has been developed and utilized as a cord element. The elongation in breaking of the polyaramid fiber is much lower than that of the nylon or Tetoron fiber: the elongation at break of the polyaramid fiber is about 6%, while the elongation at break of the nylon or Tetoron is about 20%. Therefore, it was contemplated that cords of extremely high strength could be formed by utilizing the polyaramid fiber.

However, according to the experience of the present inventor, it has been confirmed that if a cord of double-braided structure is constituted by a fiber such as the polyaramid fiber which has high strength and low elongation, the obtained cord may be stiff as a whole and may not be flexible, thus considerably increasing its fatigue by bending.

SUMMARY OF THE INVENTION

The object of the present invention is, therefore, to provide a fiber cord of braided structure wherein the mechanical strength of a high strength, low elongation fiber such as a polyaramid fiber is optimally utilized and the cord to be manufactured as a whole is not stiff but flexible, thus decreasing fatigue by bending.

A fiber cord of triple-braided structure has a core element which is formed by knitting and braiding a plurality of strands, each comprising at least one fiber filament of high elongation. Around the core a first layer element is formed by knitting and braiding a plurality of strands, each comprising at least one fiber filament of low elongation and high strength. Further, around the first layer element a second (protective) layer element is formed by knitting and braiding a plurality of strands each comprising at least one fiber element of high elongation.

Nylon or Tetoron may be used as the high elongation fiber element, while a polyaramide can be used as the low elongation, high strength fiber filament.

In the fiber cord of triple-braided structure, the elongation of the high elongation fiber and the tensile strength of the high strength fiber are optimally utilized. The cord has excellent resistance to flexural fatigue, and lower abrasion takes place between the cord elements.

DETAILED DESCRIPTION OF THE PREFERRED EMBODIMENTS

The present invention will now be described with reference to the accompanying drawings.

Figure 1:
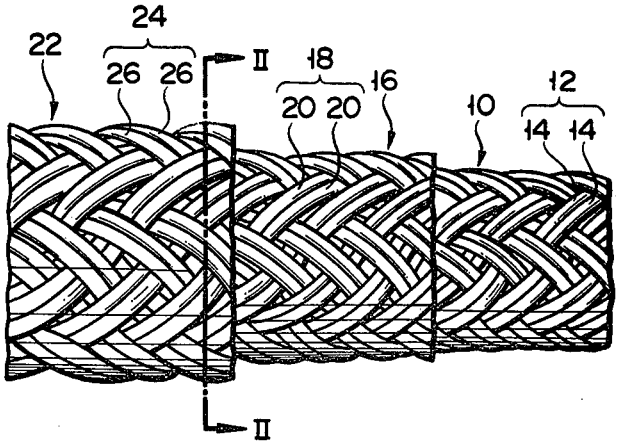
FIG. 1 is a partially cut away plan view of a fiber cord according to the present invention.

As shown in FIG. 1, a fiber cord of triple-braided structure according to the present invention comprises a core element 10 which is formed by knitting and braiding a number of strands 12 by a method known to those skilled in the art. Each strand comprises at least one fiber filament 14 of high elongation, for example, two parallel organic fiber filaments 14. Examples of organic fibers of high elongation are a nylon fiber and a Tetoron fiber. These fibers usually have an elongation at break of about 20%.

The core 10 is usually formed of 8 to 48 strands half of which (6 to 24 strands) are braided in the clockwise direction and the other half of which are braided in the counter-clockwise direction, if the strands each consists of one filament or yarn. If the strands each consists of two yarns, the core 10 will be formed of 6 to 24 strands braided as just described above.

Around the core 10, an outer layer element 16 which is cylindrical is formed by knitting and braiding a number of strands 18 by a method known to those skilled in the art. Each strand comprises at least one fiber filament 20 of low elongation, for example, two parallel fiber filaments 20. An example of a low elongation, high strength filament is a polyaramide fiber, for example, Kevlar fiber which is available from Du Pont. Such a fiber usually has an elongation at break of about 6%. The outer layer 16 is constructed by the strands as in the case of the core 10.

Figure 3:
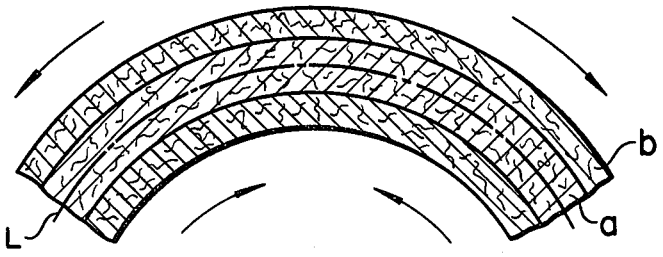
FIG. 3 is a schematic sectional view explaining the cause of bending stress in a cord of braided structure.

As described above, in the fiber cord according to the present invention, the core is formed by a fiber of high elongation, and the outer layer is formed by a fiber of low elongation and high strength. As shown in FIG. 3, it is assumed that the cord of double-braided structure is bent. When the cord is bent, the cord inside of central line L is compressed, while the cord outside the central line L is placed under tension. Wrinkles are formed at the compressed side of an outer layer b, and the braided lead of the side under tension tends to be extended to move toward a core a. The flexibility of the cord depends on the degree of the above-mentioned movement. If the core a is formed by the polyaramid fiber of high strength and low elongation, the core a elongates little, thus limiting the movement of the outer layer b. Therefore, a flexible cord cannot be obtained and the flexural fatigue is great. According to the present invention, the core is formed by a fiber of high elongation.

Referring to FIG. 1 again, a protective layer 22 is formed around the outer layer 16 in order to protect the outer layer 16 from external abrasion. The protective layer 22 is formed by knitting and braiding strands 24, each comprising at least one fiber filaments 26 of high elongation as described above. The protective layer 22 is also braided by the strands as in the case of the core 10.

When the rope is bent, frictional force acts between the core rope 10 and the outer layer rope 16, and between the outer layer rope 16 and the protective rope 22. When the fibers of the same type rub against each other, the abrasion is generally extreme. However, according to the present invention, the core rope 10 formed by a fiber such as Tetoron is placed next to the outer layer rope 16 formed by a polyaramid fiber. In this way, two different types of fibers rub against each other, and the abrasion is very small. Further, since the outer layer rope 16 is formed by the polyaramid fiber and the protective rope 22 is formed by Tetoron, the abrasion between the two fibers is also very small. Therefore, abrasion of the rope is advantageously decreased.

Figure 4:
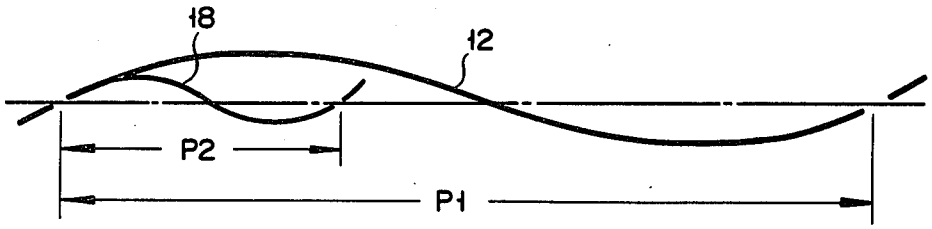
FIG. 4 is a view explaining spiral pitches of respective strands constituting core and outer layer elements of a fiber cord according to the present invention.

In order to improve the strength of the fiber rope of braided structure according to the present invention, the outer layer rope 16 is formed by a fiber of low elongation and high strength, as described above. However, it was further found that a more satisfactory rope could be obtained if the outer layer rope 16 was more tightly braided than the core. When tension is imposed on the rope, most of the load is supported by the polyaramid fiber which has a lower elongation than the outer fiber. The breaking limit of the polyaramid fiber is reached before that of the core or the protective layer. As a result, the combination of two different fibers fails to achieve its advantage in that the desired high strength cannot be obtained. In order to solve this two different fibers fails to achieve its advantage in that the desired high strength cannot be obtained. In order to solve this problem, as shown in FIG. 4, a spiral pitch P2 of the strands 18 constituting the outer layer rope is made smaller than a spiral pitch P1 of the strands 12 constituting the core rope according to the present invention. The overall elongation of the outer layer rope is increased by knitting and braiding the fiber of low elongation with a low spiral pitch. In the most preferred embodiment, the pitches P1 and P2 are selected so that the sum of the elongation of the fiber of high elongation and the elongation of the core rope 10 formed thereby is substantially equal to the sum of the elongation of the fiber of low elongation and the elongation of the outer layer rope 16 formed thereby. The optimal pitches may be determined by a simple experiment.

Figure 2:
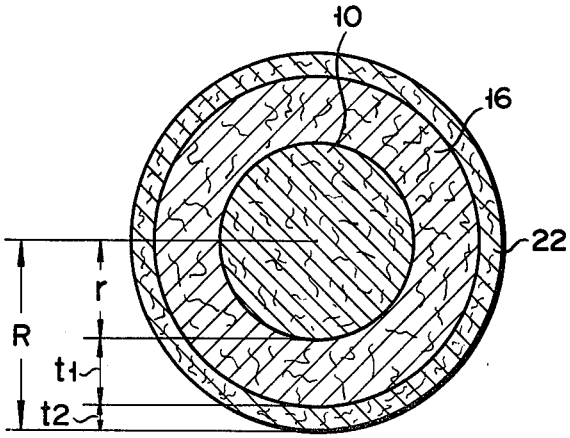
FIG. 2 is a slightly enlarged schematic sectional view along the line II—II of FIG. 1.

In general, the spiral pitch or lead of the outer layer 16 is $(8 \text{ to } 14)\times 2\times(r+t_1)$ where r is the radius of the core 10 and $t_1$ is the thickness of the outer layer 16 as shown in FIG. 2. The spiral pitch of the protective layer 22 is usually $(2.5 \text{ to } 5)\times 2\times R$ where R is the radius of the triple-braided cord. Further, spiral pitch of the core 10 is usually $(5 \text{ to } 10)\times 2\times r$.

As shown in FIG. 2, of the radius R of the triple-braided cord including the protective layer 22, Radius r of the core 10 is, for example, about $\frac{1}{2}$ R, Thickness t1 of the outer layer 16 is, for example, about $\frac{1}{3}$ R, and Thickness t2 of the protective rope 22 is about 1/6 R.

According to the cord with such a construction since the core 10 or protective layer 22 is formed by fiber of high elongation such as Tetoron, the fiber of the core 10 or protective layer 22 is elongated so that the outer layer rope 16 is freely movable toward the side of the core rope 10 when a bending stress is exerted on the outer layer rope 16 which surrounds around the core rope 10. Therefore, the rope as a whole is not hard but flexible, decreasing the flexural fatigue. Further, the spiral pitch P1 of the respective strands 12 of the core 10 is greater than the spiral pitch P2 of the respective strands 18 of the outer layer rope 16. The elongation of the strands 12 is small, while the elongation of the strands 18 is great. Therefore, the elongations of the respective strands 12 and 18 occur in accordance with the material characteristics, and when the rope is placed under tension, stress is uniformly applied to the respective strands 12 and 18 of the inner and outer layer ropes. The respective strands 12 and 18 are both utilized until the breaking limits of the strands are reached. Thus, the overall tensile strength may achieve the desired strength.

What is claimed is:

1. A fiber cord comprising:

a core element which is formed by braiding a plurality of strands, each comprising at least one organic fiber of high elongation;

an outer layer element which surrounds said core element and which is formed by braiding a plurality of strands, each comprising at least one organic fiber of low elongation; and a protective layer which surrounds said outer layer element and which is formed by braiding a plurality of strands, each comprising at least one organic fiber of high elongation.

2. A fiber cord according to claim 1, wherein a fiber of high elongation is made of nylon or polyethylene terephthalate.

3. A fiber cord according to claim 2, wherein the fiber of low elongation is made of polyaramide.

4. A fiber cord according to claim 3, wherein said outer layer braid has a spiral pitch of 8 to 14 times its diameter.

5. A fiber cord according to claim 4, wherein said protective layer braid has a spiral pitch of 2.5 to 5 times its diameter.

6. A fiber cord according to claim 5, wherein said core braid has a spiral pitch of 5 to 10 times its diameter.

7. A fiber cord according to claim 6, wherein said core element comprises 8 to 48 strands half of which are braided in the clockwise direction and the other half of which are braided in the counter-clockwise direction, and said strands each consist of one organic fiber.

8. A fiber cord according to claim 6, wherein said core element comprises 6 to 24 strands half of which are braided in the clockwise direction and the other half of which are braided in the counter-clockwise direction, and said strands each consist of one organic fiber.

* * * * *